US010559143B1

(12) United States Patent
Shen

(10) Patent No.: US 10,559,143 B1
(45) Date of Patent: Feb. 11, 2020

(54) DOOR ACCESS CONTROL METHODS WITH TWO TYPES OF UNLOCKING IDENTIFICATIONS

(71) Applicant: I-Ting Shen, Tainan (TW)

(72) Inventor: I-Ting Shen, Tainan (TW)

( * ) Notice: Subject to any disclaimer, the term of this patent is extended or adjusted under 35 U.S.C. 154(b) by 0 days.

(21) Appl. No.: 16/185,132

(22) Filed: Nov. 9, 2018

(30) Foreign Application Priority Data

Oct. 12, 2018 (TW) ..... 107136022 A

(51) Int. Cl.
*G07C 9/00* (2006.01)

(52) U.S. Cl.
CPC ..... *G07C 9/00087* (2013.01); *G07C 9/00119* (2013.01); *G07C 9/00158* (2013.01); *G07C 2009/00095* (2013.01); *G07C 2009/00507* (2013.01); *G07C 2209/08* (2013.01)

(58) Field of Classification Search
None
See application file for complete search history.

(56) References Cited

U.S. PATENT DOCUMENTS

| | | | | |
|---|---|---|---|---|
| 8,768,565 | B2 * | 7/2014 | Jefferies | G07B 15/00 701/32.7 |
| 9,858,739 | B1 * | 1/2018 | Johnson | G07C 9/00309 |
| 9,984,523 | B1 * | 5/2018 | Shen | G07C 9/00174 |
| 10,343,650 | B1 * | 7/2019 | Ahmad | B60R 25/23 |
| 2015/0120151 | A1 * | 4/2015 | Akay | B60R 25/24 701/49 |
| 2018/0123841 | A1 * | 5/2018 | Wilhelmsson | H04L 1/0053 |

* cited by examiner

*Primary Examiner* — Carlos Garcia
(74) *Attorney, Agent, or Firm* — Alan D. Kamrath; Karin L. Williams; Mayer & Williams

(57) ABSTRACT

Door access control methods with two types of identifications use at least one of a biological unlocking identification and a non-biological unlocking identification. The first type of identification and the second type of identification can be used independently or jointly to control the locking state of a door access device correlated to a door access system.

13 Claims, 3 Drawing Sheets

DOOR ACCESS CONTROL METHODS WITH TWO TYPES OF UNLOCKING IDENTIFICATIONS

BACKGROUND OF THE INVENTION

The present invention relates to door access control methods with two types of unlocking identifications and, more particularly, to door access control methods using at least one of a biological unlocking identification and a non-biological unlocking identification.

Door access control is one of a plurality of methods enabling managing personnel to control access to one or more doors as well as providing an anti-burglar effect. Door access control is particularly useful in a situation or a space where many people or unspecified people can enter and leave. With the progress of technologies, door access control has evolved from manual approaches to electronic methods. Some door access control methods use pin numbers, electronic keys or biological features and are generally classified into a biological identification type (such as fingerprints or a facial pattern) and a non-biological identification type (such as pin numbers or encoded packets).

These electronic door access control methods generally include only one of the biological identification and the non-biological identification. However, these electronic door access control methods lack flexibility, and no other means is provided to instantly release the door access control when the identification system malfunctions or is out of order.

Furthermore, it is difficult for the personnel monitoring people passing through the door if only the non-biological identification is used for controlling the door access.

BRIEF SUMMARY OF THE INVENTION

In a first aspect, a door access control method includes:

selecting one of a first type of identification and a second type of identification;

picking up a biological feature of a person by one of a smart mobile device and a smart wear device when the first type of identification is selected, wherein the biological feature is sent to and stored in a door access system:

transmitting an identification information including a hardware identification code of a door access device correlated to the door access system to the smart phone device or the smart wear device, wherein the identification information is stored in the one of the smart phone device and the smart wear device to form a mobile key:

deciding whether to activate a biological identification, wherein the mobile key is not used to pick up the biological feature when the biological identification is not activated, wherein the mobile key is used to pick up the biological feature when the biological identification is activated, wherein the identification information and the biological feature picked up by the mobile key are encoded by the mobile key as a packet when the biological feature is picked up successfully, and wherein the identification information is not encoded as the packet when the biological feature is not picked up successfully;

transmitting the packet to the door access device by the mobile key:

decoding the packet to obtain the identification information and the biological feature;

identifying the identification information and the biological feature, wherein the door access device remains locked when at least one of the identification information and the biological feature is incorrect, wherein the door access device is unlocked when both the identification information and the biological feature are correct;

manually checking an identity of the person when the second type of identification is selected, wherein an electronic key is provided to the person when the identity is correct, and wherein the electronic key is not provided to the person when the identity is incorrect; and placing the electronic key near the door access device, with the door access device reading an unlocking information stored in the electronic key, wherein the door access device remains locked when the unlocking information in the electronic key is identified incorrect, and wherein the door access device is unlocked when the unlocking information in the electronic key is identified correct.

In a second aspect, a door access control method includes:

picking up a biological feature of a person by one of a smart mobile device and a smart wear device, wherein the biological feature is sent to and stored in a door access system:

transmitting an identification information including a hardware identification code of a door access device correlated to the door access system to the one of the smart phone device and the smart wear device, wherein the identification information is stored in the one of the smart phone device and the smart wear device to form a mobile key;

manually checking an identity of the person, wherein an electronic key is provided to the person when the identity is correct, and wherein the electronic key is not provided to the person when the identity is incorrect;

deciding whether to activate a biological identification, wherein the mobile key is not used to pick up the biological feature when the biological identification is not activated, wherein the mobile key is used to pick up the biological feature when the biological identification is activated, wherein the identification information and the biological feature picked up by the mobile key are encoded by the mobile key as a packet when the biological feature is picked up successfully, and wherein the identification information is not encoded as the packet when the biological feature is not picked up successfully;

transmitting the packet to the door access device by the mobile key;

decoding the packet to obtain the identification information and the biological feature;

identifying the hardware identification code and the biological feature, wherein the door access device remains locked when at least one of the hardware identification code and the biological feature are incorrect; and placing the electronic key near the door access device when both the hardware identification code and the biological feature are correct, with the door access device reading an unlocking information stored in the electronic key, wherein the door access device remains locked when the unlocking information in the electronic key is identified incorrect, and wherein the door access device is unlocked when the unlocking information in the electronic key is identified correct.

In a third aspect, a door access control method includes:

picking up a biological feature of a person by one of a smart mobile device and a smart wearing device, wherein the biological feature is sent to and stored in a door access system;

transmitting an identification information including a hardware identification code of a door access device correlated to the door access system to the one of the smart phone device and the smart wear device, wherein the identification information is stored in the one of the smart phone device and the smart wear device to form a mobile key;

manually checking an identity of the person, wherein an electronic key is provided to the person when the identity is correct, and wherein the electronic key is not provided to the person when the identity is incorrect;

placing the electronic key near the door access device, with the door access device reading an unlocking information stored in the electronic key, wherein the door access device remains locked when the unlocking information in the electronic key is identified incorrect, wherein the mobile key is used to pick up the biological feature of the person when the unlocking information is correct, wherein the identification information and the biological feature picked up by the mobile key are encoded by the mobile key as a packet when the biological feature is picked up successfully, and wherein the identification information is not encoded as the packet when the biological feature is not picked up successfully;

transmitting the packet to the door access device by the mobile key:

decoding the packet to obtain the identification information and the biological feature, and identifying the hardware identification code and the biological feature, wherein the door access device remains locked when at least one of the hardware identification code and the biological feature is incorrect, and wherein the door access device is unlocked when both the hardware identification code and the biological feature are correct.

In a fourth aspect, a door access control method includes:

providing a person with a first type of identification and a second type of identification, wherein the person firstly uses the first type of identification, and wherein the person uses the second type of identification when the first type of identification fails or is erroneous or when in an emergency situation;

wherein the first type of identification includes:

picking up a biological feature of the person by one of a smart mobile device and a smart wear device, wherein the biological feature is sent to and stored in a door access system;

transmitting an identification information including a hardware identification code of a door access device correlated to the door access system to the one of the smart phone device and the smart wear device, wherein the identification information is stored in the one of the smart phone device and the smart wear device to form a mobile key;

deciding whether to activate a biological identification, wherein the mobile key is not used to pick up the biological feature when the biological identification is not activated), wherein the mobile key is used to pick up the biological feature when the biological identification is activated, wherein the identification information and the biological feature picked up by the mobile key are encoded by the mobile key as a packet when the biological feature is picked up successfully, and wherein the identification information is not encoded as the packet when the biological feature is not picked up successfully;

transmitting the packet to the door access device by the mobile key;

decoding the packet to obtain the identification information and the biological feature;

identifying the identification information and the biological feature, wherein the door access device remains locked when at least one of the identification information and the biological feature is incorrect, and wherein the door access device is unlocked when both the identification information and the biological feature are correct;

wherein the second type of identification includes:

manually checking an identity of the person, wherein an electronic key is provided to the person when the identity is correct, and wherein the electronic key is not provided to the person when the identity is incorrect; and placing the electronic key near the door access device, with the door access device reading an unlocking information stored in the electronic key, wherein the door access device remains locked when the unlocking information in the electronic key is identified incorrect, and wherein the door access device is unlocked when the unlocking information in the electronic key is identified correct.

In any one of the above aspects, the identification information transmitted to and stored in the one of the smart phone device and the smart wear device further includes an access permission start time and an access permission end time correlated to the door access device. The access permission start time, the access permission end time, the hardware identification code, and the biological feature are encoded as the packet when the biological feature is picked up successfully. The door access device remains locked when at least one of the hardware identification code and the biological feature are identified incorrect or when the hardware identification code and the biological feature are identified at a time prior to the access permission start time or after the access permission end time. The door access device is unlocked when the hardware identification code and the biological feature are identified correct and are identified at a time between the access permission start time and the access permission end time.

In any one of the above aspects, the biological feature includes at least one of a facial information, fingerprints, a vocal pattern, an iris image, and a finger vein image of an owner of the mobile key.

In the first aspect, the first type of identification is selected first, and wherein the second type of identification is selected after the first type of identification fails or is unable to be executed.

The present invention will become clearer in light of the following detailed description of illustrative embodiments of this invention described in connection with the drawings.

DETAILED DESCRIPTION OF THE INVENTION

Figure 1:
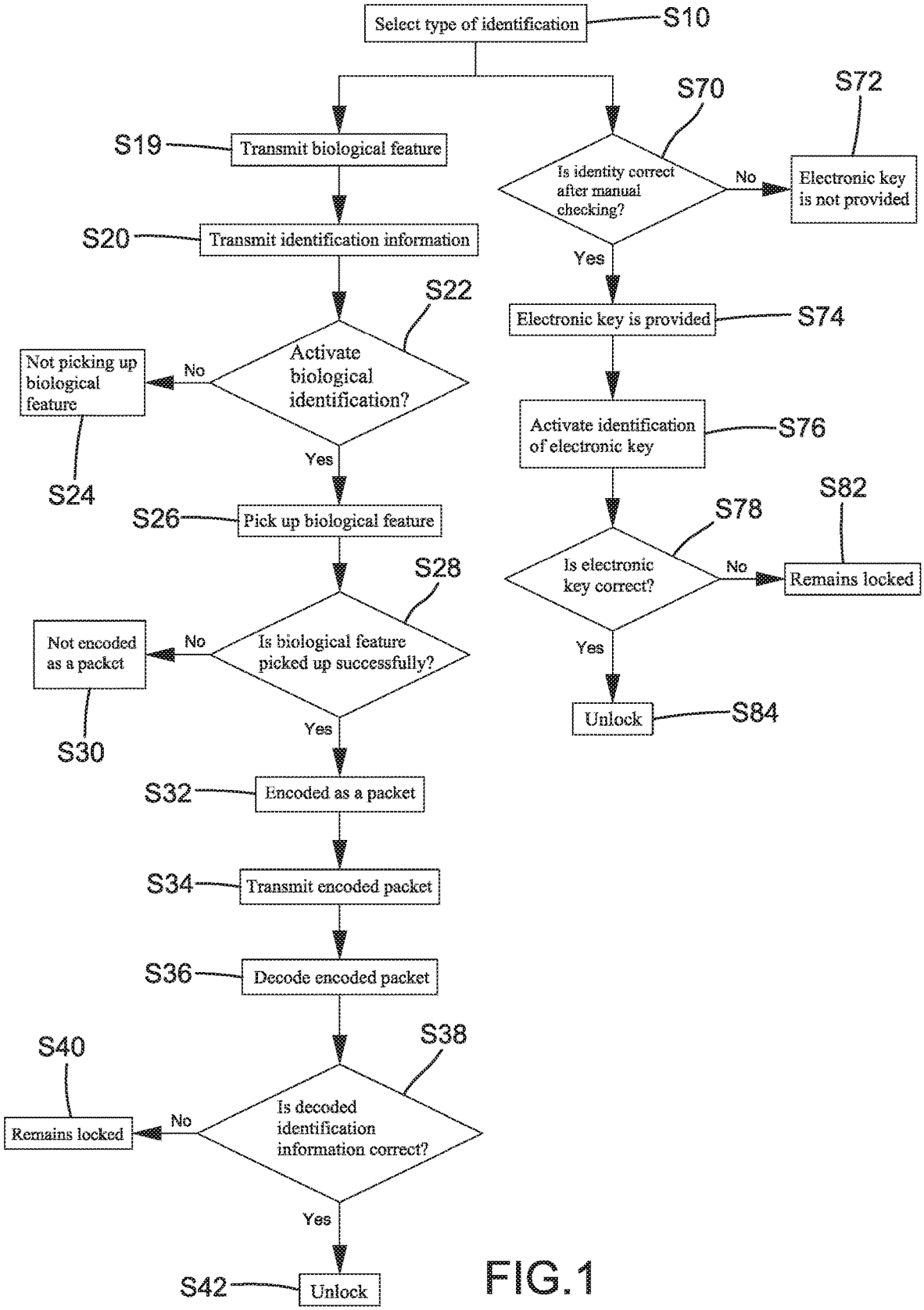
FIG. 1 is a diagrammatic flowchart illustrating a door access control method with two types of unlocking identifications of a first embodiment according to the present invention.

The present invention relates to door access control methods with two types of unlocking identifications for door access control of a door access system using one or more door access devices. FIG. 1 is a diagrammatic flowchart illustrating a door access control method with two types of unlocking identifications of a first embodiment according to the present invention. The door access control method can use biological features (the first identification type, such as facial information, fingerprints, vocal patterns, iris, or finger veins) or non-biological features (the second identification type, such as door access cards, electronic keys) to set a selected door access device to an unlocked state. The door access control method of the first embodiment includes selecting a type of identification by a person intending to pass through the selected door access control device (S10). Specifically, the person selects one of the first type of identification and the second type of identification to access the door access device.

When the first type of identification is selected, one of a smart mobile device and a smart wear device is used to pick up a biological feature of the person, and the biological feature is sent to and stored in a door access system (S19). The biological feature can be transmitted through the Internet or a mobile network and can be executed remotely. After the door access system receives the biological feature of the person, an identification information including a hardware identification code of the selected door access device correlated to the door access system is transmitted to the one of the smart phone device and the smart wear device. The identification information is stored in the one of the smart phone device and the smart wear device to form a mobile key (S20). The identification information transmitted to and stored in the one of the smart phone device and the smart wear device can further include an access permission start time and an access permission end time correlated to the door access device. The identification information can be transmitted through the Internet or a mobile network and can be executed remotely.

The door access control method further includes deciding whether to activate a biological identification (S22). The mobile key is not used to pick up the biological feature when the biological identification is not activated (S24). On the other hand, the mobile key is used to pick up the biological feature when the biological identification is activated (S26). Specifically, whether to activate the biological identification (S22) is carried out only when the person is near and intends to unlock the selected door access device. Activation of the biological identification includes the person using a biological feature pick-up device (such as a camera, a fingerprint pick-up device, a microphone, an iris image pick-up device, or a finger vein image pick-up device) of the mobile key (the one of the smart mobile device and the smart wear device) to pick up the biological feature (such as the facial information, the fingerprints, the iris image, or the finger veins).

In step S28, it is identified whether the biological feature is picked up successfully. The identification information is not encoded as a packet when the biological feature is not picked up successfully (S30). On the other hand, when the biological feature is picked up successfully, the identification information and the biological feature picked up by the mobile key are encoded by the mobile key as the packet (S32). As an example, the person uses the biological feature pick-up device (such as the fingerprint pick-up device) of the mobile key to input the biological feature (such as a fingerprint) of the person under guidance of a door access application installed in the one of the smart mobile device and the smart wear device. When the biological feature is not successfully picked up by the mobile key, the access permission start time, the access permission end time, the hardware identification code, and the biological feature are not encoded by as the packet when the biological feature is not picked up successfully (S30). On the other hand, when the biological feature is picked up successfully by the mobile key, the access permission start time, the access permission end time, the hardware identification code, and the biological feature are encoded by the door access application as the packet (S32), and the packet is transmitted by the mobile key to the door access device (S34). Specifically, the packet can be transmitted to the door access device through a communication technology, such as the Internet, a mobile network, Bluetooth, near-field communication (NFC), or radio frequency identification (RFID). The encoding in step S32 includes converting the access permission start time, the access permission end time, the hardware identification code, and the biological feature into unidentifiable garbled codes or symbols through algorithms.

After the door access device has received the packet, the packet is decoded by a decoding key to obtain the access permission start date, the access permission end date, the hardware identification code, and the biological feature (S36). The decoding key converts the unidentifiable garbled codes back into the original, identifiable information including the hardware identification code, the biological feature, the access permission start time, and the access permission end time.

After decoding, the identification information and the biological feature are identified correct or not (S38). The door access device remains locked when at least one of the hardware identification code and the biological feature are identified incorrect or when the hardware identification code and the biological feature are identified at a time (the identification time) prior to the access permission start time or after the access permission end time (S40). On the other hand, the door access device is unlocked when the hardware identification code and the biological feature are identified correct and are identified at a time (the identification time) between the access permission start time and the access permission end time (S42). Thus, the person can access the door access device, such as opening a door to enter by unlocking a door lock.

Particularly, the biological feature obtained after decoding the packet is compared with the biological feature stored in the door access system, and the hardware identification code obtained after decoding the packet is compared with the hardware identification code of the door access device. Identification of the hardware identification code assists the door access system in identifying whether the to-be-unlocked door access device is the selected door access device. Determination of whether the identification time is between the access permission start time and the access permission end time can be based on a timer of the door access device or the date and time obtained through internet connection. By identifying whether the identification time after decoding is between the access permission start time and the access permission end time can avoid an unauthorized person (whose authorized period of time has expired) from setting the door access device to the unlocked state.

In a case that the person selects the second type of identification, the identity of the person is manually checked (S70). An electronic key is provided to the person when the identity is correct (S74). On the other hand, the electronic key is not provided to the person when the identity is incorrect (S72). The person can place the electronic key near the door access device, and the door access device reads an unlocking information stored in the electronic key to identify whether the electronic key is correct (S76 and S78). The door access device remains locked when the unlocking information in the electronic key is identified incorrect (S82). On the other hand, the door access device is unlocked when the unlocking information in the electronic key is identified correct (S84).

It is noted that selection of the first and second type of identifications is not limited in sequence. Namely, the person can decide which type of identification to be used.

The door access control method of the first embodiment according to the present invention provides first and second types of identifications (the biological feature identification and the non-biological feature identification) that can be operated independently. The person intending to access the door access device can select the desired type of identification, which is convenient in use.

Furthermore, the door access control method of the first embodiment according to the present invention provides a manager with two types of identifications that can be operated independently. For example, the manager can select the first type of identification (the biological feature identification) in a normal situation and can provide the second type of identification (the non-biological feature identification) in an emergency situation or when the biological feature identification fails or malfunctions). This applies in door access management of a hotel or the like. In a normal situation, a hotel guest uses the biological feature identification to unlock the door access device of a room of a hotel. When the biological feature identification fails, the hotel guest can obtain an electronic key from the counter of the hotel after manually checking the identity of the hotel guest, and the hotel guest can unlock the door access device of the room with the electronic key and then enter the room. When an emergency situation occurs, the personnel of the hotel can use the electronic key to forcibly enter the room without the biological feature identification. This is convenient to in environments (such as hotels) that permit non-specific people to pass in and out.

Figure 2:
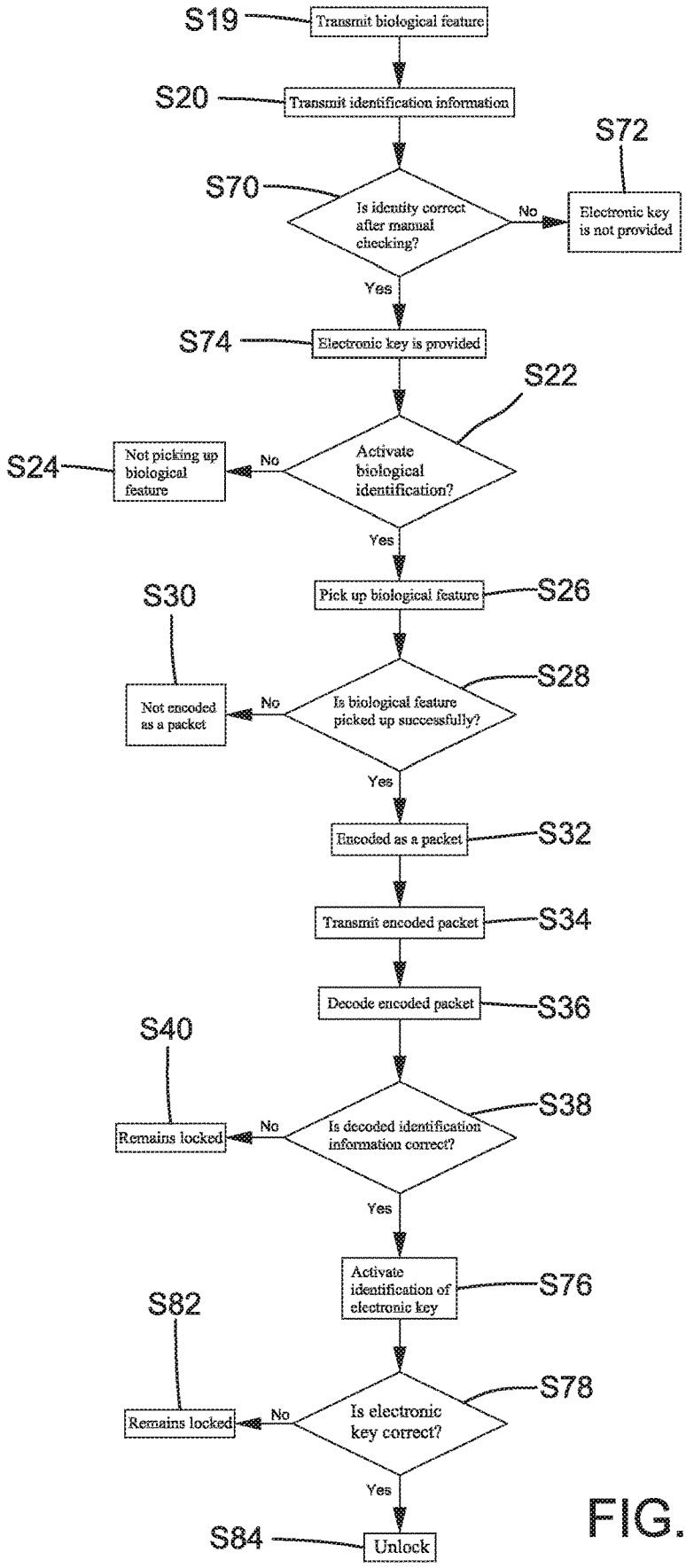
FIG. 2 is a diagrammatic flowchart illustrating a door access control method with two types of unlocking identifications of a second embodiment according to the present invention.

FIG. 2 is a diagrammatic flowchart illustrating a door access control method with two types of unlocking identifications of a second embodiment according to the present invention. In this embodiment, the second type of identification is carried out after the first type of identification has been completed successfully, and the door access device is unlocked after the second type of identification has been completed successfully. Specifically, the person uses one of the smart mobile device and the smart wear device is used to pick up a biological feature of the person, and the biological feature is sent to and stored in a door access system through the Internet or a mobile network (S19).

After receiving the biological feature from the one of the smart mobile device and the smart wear device, the door access system transmits an identification information including a hardware identification code, an access permission start time, and an access permission end time of a door access device correlated to the door access system back to the one of the smart phone device and the smart wear device, and the identification information is stored in the smart phone device or the smart wear device to form a mobile key (S20).

When the person reports to, e.g., a counter of a hotel, the identity of the person is manually checked (S70). An electronic key is provided to the person when the identity is correct (S74). On the other hand, the electronic key is not provided to the person when the identity is incorrect (S72).

The door access control method of the second embodiment further includes deciding whether to activate a biological identification (S22). The mobile key is not used to pick up the biological feature when the biological identification is not activated (S24) (for example, the person is far from the door access device). The mobile key is used to pick up the biological feature when the biological identification is activated (S26) (for example, the person is near the door access device). In step S28, it is identified whether the biological feature is picked up successfully. The identification information is not encoded as the packet when the biological feature is not picked up successfully (S30). Namely, without the biological feature, the door access application stored in the mobile key will not encode the hardware identification code, the access permission start time, and the access permission end time as a packet. On the other hand, when the biological feature is picked up successfully, the biological feature, the hardware identification code, the access permission start time, and the access permission end time are encoded by the door access application of the mobile key as the packet (S32). Next, the packet is transmitted to the door access device by the mobile key (S34). After the door access device has received the packet, the packet is decoded to obtain the access permission start date, the access permission end date, the hardware identification code, and the biological feature (S36).

After decoding, the identification information and the biological feature are identified correct or not (S38). The door access device compares the biological feature obtained after decoding with the biological feature stored in the door access system and compares the hardware identification code obtained after decoding with the hardware identification code of the door access device. Furthermore, the door access device identifies whether the identification time is between the access permission start time and the access permission end time. The door access device remains locked when at least one of the hardware identification code and the biological feature are identified incorrect or when the identification time is prior to the access permission start time or after the access permission end time (S40). On the other hand, when the hardware identification code and the biological feature are identified correct and the identification time is between the access permission start time and the access permission end time, identification of the electronic key is carried out (S76). Specifically, the person places the electronic key near the door access device (S42), and the door access device reads an unlocking information stored in the electronic key. The door access device remains locked when the unlocking information in the electronic key is identified incorrect (S82). The door access device is unlocked when the unlocking information in the electronic key is identified correct (S84).

Figure 3:
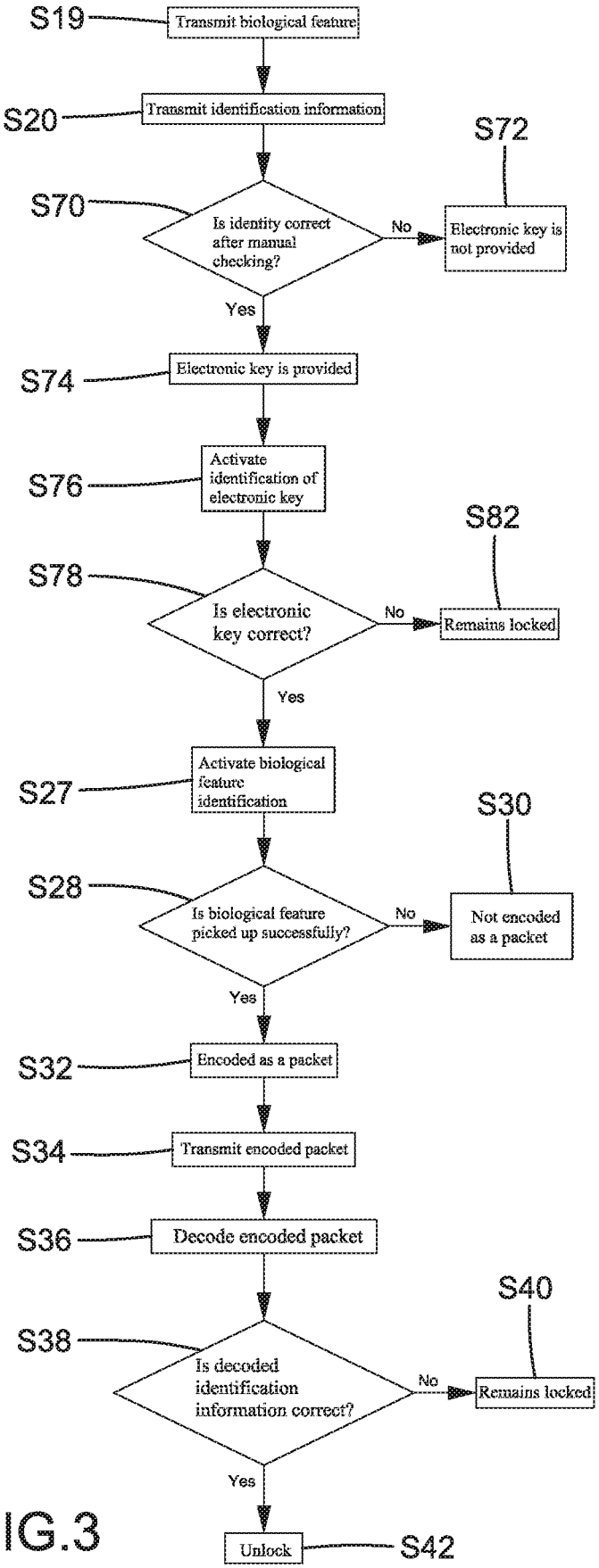
FIG. 3 is a diagrammatic flowchart illustrating a door access control method with two types of unlocking identifications of a third embodiment according to the present invention.

FIG. 3 is a diagrammatic flowchart illustrating a door access control method with two types of unlocking identifications of a third embodiment according to the present invention. In this embodiment, the first type of identification is carried out after the second type of identification has been completed successfully, and the door access device is unlocked after the first type of identification has been completed successfully. Specifically, the person uses one of the smart mobile device and the smart wear device to pick up a biological feature of the person, and the biological feature is sent to and stored in a door access system through the Internet or a mobile network (S19).

After receiving the biological feature from the one of the smart mobile device and the smart wear device, the door access system transmits an identification information including a hardware identification code of a door access device correlated to the door access system back to the one of the smart phone device and the smart wear device, and the identification information is stored in the one of the smart phone device and the smart wear device to form a mobile key (S20).

When the person reports to, e.g., a counter of a hotel, the identity of the person is manually checked (S70). An electronic key (such as a door access card) is provided to the person when the identity is correct (S74). On the other hand, the electronic key is not provided to the person when the identity is incorrect (S72).

Identification of the electronic key is carried out when the person is near the door access device (S76). Specifically, the electronic key is placed near the door access device, and the door access device reads the unlocking information stored in the electronic key to identify whether the electronic key is correct (S78). The door access device remains locked when the unlocking information in the electronic key is identified incorrect (S82). On the other hand, when the unlocking information is identified correct, the biological feature identification is carried out (S27). The door access application stored in the mobile key guides the person to input the biological feature, and the mobile key identifies whether the biological feature is picked up successfully. The identification information is not encoded as a packet when the biological feature is not picked up successfully (S30). Namely, without the biological feature, the door access application stored in the mobile key will not encode the hardware identification code, the access permission start time, and the access permission end time as the packet. On the other hand, when the biological feature is picked up successfully, the biological feature, the hardware identification code, the access permission start time, and the access permission end time are encoded by the door access application of the mobile key as the packet (S32). Next, the packet is transmitted to the door access device by the mobile key (S34). After the door access device has received the packet, the packet is decoded to obtain the access permission start date, the access permission end date, the hardware identification code, and the biological feature (S36).

After decoding, the identification information and the biological feature are identified correct or not (S38). The door access device compares the biological feature obtained after decoding with the biological feature stored in the door access system and compares the hardware identification code obtained after decoding with the hardware identification code of the door access device. Furthermore, the door access device identifies whether the identification time is between the access permission start time and the access permission end time. The door access device remains locked when at least one of the hardware identification code and the biological feature are identified incorrect or when the identification time is prior to the access permission start time or after the access permission end time (S40). On the other hand, when the hardware identification code and the biological feature are identified correct and the identification time is between the access permission start time and the access permission end time, the door access device is unlocked.

The door access methods of the second and third embodiments using two types of identifications according to the present invention provide door access control with higher safety. Namely the door access device can be unlocked only both the first and second types of identification are successful. Thus, even if the electronic key (such as a door access card) is lost, the person picking up the electronic key cannot use it to unlock the door access device, which is relatively safe.

Furthermore, in the door access methods of the second and third embodiments according to the present invention, the biological feature must be inputted during unlocking of the door access device. Thus, the identify of the person intending to pass the door access device can be identified and recorded, which is helpful in the door access management.

Now that the basic teachings of the present invention have been explained, many extensions and variations will be obvious to one having ordinary skill in the art. For example, the identification information does not have to include the access permission start time and the access permission end time, because the access permission start time and the access permission end time are only helpful in temporary door access control on non-specific persons but are not necessary to long-term door access control of specific persons.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A door access control method comprising:

selecting one of a first type of identification and a second type of identification;

picking up a biological feature of a person by one of a smart mobile device and a smart wear device when the first type of identification is selected, wherein the biological feature is sent to and stored in a door access system;

transmitting an identification information including a hardware identification code of a door access device correlated to the door access system to the smart mobile device or the smart wear device, wherein the identification information is stored in the one of the smart mobile device and the smart wear device to form a mobile key;

deciding whether to activate a biological identification, wherein the mobile key is not used to pick up the biological feature when the biological identification is not activated, wherein the mobile key is used to pick up the biological feature when the biological identification is activated, wherein the identification information and the biological feature picked up by the mobile key are encoded by the mobile key as a packet when the biological feature is picked up successfully, and wherein the identification information is not encoded as the packet when the biological feature is not picked up successfully;

transmitting the packet to the door access device by the mobile key;

decoding the packet to obtain the identification information and the biological feature;

identifying the identification information and the biological feature, wherein the door access device remains locked when at least one of the identification information and the biological feature is incorrect, wherein the door access device is unlocked when both the identification information and the biological feature are correct;

manually checking an identity of the person when the second type of identification is selected, wherein an electronic key is provided to the person when the identity is correct, and wherein the electronic key is not provided to the person when the identity is incorrect; and placing the electronic key near the door access device, with the door access device reading an unlocking information stored in the electronic key, wherein the door access device remains locked when the unlocking information in the electronic key is identified incorrect, and wherein the door access device is unlocked when the unlocking information in the electronic key is identified correct.

2. The door access control method as claimed in claim 1, wherein the first type of identification is selected first, and wherein the second type of identification is selected after the first type of identification fails or is unable to be executed.

3. The door access control method as claimed in claim 1, wherein the identification information transmitted to and stored in the one of the smart mobile device and the smart wear device further includes an access permission start time and an access permission end time correlated to the door access device, wherein the access permission start time, the access permission end time, the hardware identification code, and the biological feature are encoded as the packet when the biological feature is picked up successfully, wherein the door access device remains locked when at least one of the hardware identification code and the biological feature are identified incorrect or when the hardware identification code and the biological feature are identified at a time prior to the access permission start time or after the access permission end time, and wherein the door access device is unlocked when the hardware identification code and the biological feature are identified correct and are identified at a time between the access permission start time and the access permission end time.

4. The door access control method as claimed in claim 1, wherein the biological feature includes at least one of a facial information, fingerprints, a vocal pattern, an iris image, and a finger vein image of an owner of the mobile key.

5. A door access control method comprising:

picking up a biological feature of a person by one of a smart mobile device and a smart wear device, wherein the biological feature is sent to and stored in a door access system;

transmitting an identification information including a hardware identification code of a door access device correlated to the door access system to the one of the smart mobile device and the smart wear device, wherein the identification information is stored in the one of the smart mobile device and the smart wear device to form a mobile key;

manually checking an identity of the person, wherein an electronic key is provided to the person when the identity is correct, and wherein the electronic key is not provided to the person when the identity is incorrect;

deciding whether to activate a biological identification, wherein the mobile key is not used to pick up the biological feature when the biological identification is not activated, wherein the mobile key is used to pick up the biological feature when the biological identification is activated, wherein the identification information and the biological feature picked up by the mobile key are encoded by the mobile key as a packet when the biological feature is picked up successfully, and wherein the identification information is not encoded as the packet when the biological feature is not picked up successfully;

transmitting the packet to the door access device by the mobile key;

decoding the packet to obtain the identification information and the biological feature;

identifying the hardware identification code and the biological feature, wherein the door access device remains locked when at least one of the hardware identification code and the biological feature are incorrect; and placing the electronic key near the door access device when both the hardware identification code and the biological feature are correct, with the door access device reading an unlocking information stored in the electronic key, wherein the door access device remains locked when the unlocking information in the electronic key is identified incorrect, and wherein the door access device is unlocked when the unlocking information in the electronic key is identified correct.

6. The door access control method as claimed in claim 5, wherein the identification information transmitted to and stored in the one of the smart mobile device and the smart wear device further includes an access permission start time and an access permission end time correlated to the door access device, wherein the access permission start time, the access permission end time, the hardware identification code, and the biological feature are encoded as the packet when the biological feature is picked up successfully, wherein the door access device remains locked when at least one of the hardware identification code and the biological feature are identified incorrect or when the hardware identification code and the biological feature are identified at a time prior to the access permission start time or after the access permission end time, and wherein the door access device is unlocked when the hardware identification code and the biological feature are identified correct and are identified at a time between the access permission start time and the access permission end time.

7. The door access control method as claimed in claim 5, wherein the biological feature includes at least one of a facial information, fingerprints, a vocal pattern, an iris image, and a finger vein image of an owner of the mobile key.

8. A door access control method comprising:

picking up a biological feature of a person by one of a smart mobile device and a smart wearing device, wherein the biological feature is sent to and stored in a door access system;

transmitting an identification information including a hardware identification code of a door access device correlated to the door access system to the one of the smart mobile device and the smart wear device, wherein the identification information is stored in the one of the smart mobile device and the smart wear device to form a mobile key;

manually checking an identity of the person, wherein an electronic key is provided to the person when the identity is correct, and wherein the electronic key is not provided to the person when the identity is incorrect;

placing the electronic key near the door access device, with the door access device reading an unlocking information stored in the electronic key, wherein the door access device remains locked when the unlocking information in the electronic key is identified incorrect, wherein the mobile key is used to pick up the biological feature of the person when the unlocking information is correct, wherein the identification information and the biological feature picked up by the mobile key are encoded by the mobile key as a packet when the biological feature is picked up successfully, and wherein the identification information is not encoded as the packet when the biological feature is not picked up successfully;

transmitting the packet to the door access device by the mobile key;

decoding the packet to obtain the identification information and the biological feature; and identifying the hardware identification code and the biological feature, wherein the door access device remains locked when at least one of the hardware identification code and the biological feature is incorrect, and wherein the door access device is unlocked when both the hardware identification code and the biological feature are correct.

9. The door access control method as claimed in claim 8, wherein the identification information transmitted to and stored in the one of the smart mobile device and the smart wear device further includes an access permission start time and an access permission end time correlated to the door access device, wherein the access permission start time, the access permission end time, the hardware identification code, and the biological feature are encoded as the packet when the biological feature is picked up successfully, wherein the door access device remains locked when at least one of the hardware identification code and the biological feature are identified incorrect or when the hardware identification code and the biological feature are identified at a time prior to the access permission start time or after the access permission end time, and wherein the door access device is unlocked when the hardware identification code and the biological feature are identified correct and are identified at a time between the access permission start time and the access permission end time.

10. The door access control method as claimed in claim 8, wherein the biological feature includes at least one of a facial information, fingerprints, a vocal pattern, an iris image, and a finger vein image of an owner of the mobile key.

11. A door access control method comprising:

providing a person with a first type of identification and a second type of identification, wherein the person firstly uses the first type of identification, and wherein the person uses the second type of identification when the first type of identification fails or is erroneous or when in an emergency situation;

wherein the first type of identification includes:

picking up a biological feature of the person by one of a smart mobile device and a smart wear device, wherein the biological feature is sent to and stored in a door access system;

transmitting an identification information including a hardware identification code of a door access device correlated to the door access system to the one of the smart mobile device and the smart wear device, wherein the identification information is stored in the one of the smart mobile device and the smart wear device to form a mobile key;

deciding whether to activate a biological identification, wherein the mobile key is not used to pick up the biological feature when the biological identification is not activated), wherein the mobile key is used to pick up the biological feature when the biological identification is activated, wherein the identification information and the biological feature picked up by the mobile key are encoded by the mobile key as a packet when the biological feature is picked up successfully, and wherein the identification information is not encoded as the packet when the biological feature is not picked up successfully;

transmitting the packet to the door access device by the mobile key;

decoding the packet to obtain the identification information and the biological feature;

identifying the identification information and the biological feature, wherein the door access device remains locked when at least one of the identification information and the biological feature is incorrect, and wherein the door access device is unlocked when both the identification information and the biological feature are correct;

wherein the second type of identification includes:

manually checking an identity of the person, wherein an electronic key is provided to the person when the identity is correct, and wherein the electronic key is not provided to the person when the identity is incorrect, and placing the electronic key near the door access device, with the door access device reading an unlocking information stored in the electronic key, wherein the door access device remains locked when the unlocking information in the electronic key is identified incorrect, and wherein the door access device is unlocked when the unlocking information in the electronic key is identified correct.

12. The door access control method as claimed in claim 11, wherein the identification information transmitted to and stored in the one of the smart mobile device and the smart wear device further includes an access permission start time and an access permission end time correlated to the door access device, wherein the access permission start time, the access permission end time, the hardware identification code, and the biological feature are encoded as the packet when the biological feature is picked up successfully, wherein the door access device remains locked when at least one of the hardware identification code and the biological feature are identified incorrect or when the hardware identification code and the biological feature are identified at a time prior to the access permission start time or after the access permission end time, and wherein the door access device is unlocked when the hardware identification code and the biological feature are identified correct and are identified at a time between the access permission start time and the access permission end time.

13. The door access control method as claimed in claim 11, wherein the biological feature includes at least one of a facial information, fingerprints, a vocal pattern, an iris image, and a finger vein image of an owner of the mobile key.

* * * * *